US009613475B2

(12) United States Patent
Zivkovic et al.

(10) Patent No.: US 9,613,475 B2
(45) Date of Patent: Apr. 4, 2017

(54) COMMUNICATIONS WITH INTERACTION DETECTION

(71) Applicant: NXP B.V., Eindhoven (NL)

(72) Inventors: Zoran Zivkovic, Hertogenbosch (NL); Liang Li, Hamburg (DE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 14/722,800

(22) Filed: May 27, 2015

(65) Prior Publication Data

US 2016/0350987 A1 Dec. 1, 2016

(51) Int. Cl.
*G07C 9/00* (2006.01)

(52) U.S. Cl.
CPC ..... *G07C 9/00007* (2013.01); *G07C 9/00174* (2013.01); *G07C 2009/00555* (2013.01); *G07C 2209/63* (2013.01)

(58) Field of Classification Search
CPC ..... G07C 9/00007; G07C 9/00309; H04W 24/08; B60R 25/245
See application file for complete search history.

(56) References Cited

U.S. PATENT DOCUMENTS 6,218,932 B1 * 4/2001 Stippler ..... B60R 25/04 307/10.2
6,617,961 B1 * 9/2003 Janssen ..... B60R 25/245 307/10.1
6,850,148 B2 * 2/2005 Masudaya ..... B60R 25/24 340/5.61
6,960,981 B2 * 11/2005 Blatz ..... B60R 25/00 340/10.4
6,970,679 B2 * 11/2005 Blatz ..... G06K 19/0723 333/1.1
6,980,686 B2 * 12/2005 Kuwabara ..... G06T 7/001 382/144
6,992,568 B2 * 1/2006 Perraud ..... G06K 7/0008 340/10.3
7,034,656 B2 * 4/2006 Buchner ..... B60R 25/24 340/10.1

(Continued)

OTHER PUBLICATIONS

Flury et al., "Effectiveness of Distance-Decreasing Attacks Against Impulse Radio Ranging", WiSec 2010.

(Continued)

*Primary Examiner* — Brian Miller
(74) *Attorney, Agent, or Firm* — Rajeev Madnawat

(57) ABSTRACT

Aspects of the disclosure are directed to detecting interactions with signals, such as by an attacker attempting to gain access to a vehicle. Signal waveforms used for authentication are evaluated, for communications between respective circuits. Possible interaction by a third circuit is analyzed by detecting variations in characteristics of a leading portion of a data symbol relative to known characteristics of the leading portion of the data signal. A condition indicative of whether the signal waveform has been interacted with and retransmitted is determined, based on the detected variations. For instance, if the variations are indicative of a known type of variation induced by interaction and retransmission, such interaction and transmission can be detected. Where the determined condition is not deemed an attack, an output signal that provides vehicle access is generated based on the determined condition.

20 Claims, 3 Drawing Sheets

(56) References Cited

U.S. PATENT DOCUMENTS

| | | | | |
|---|---|---|---|---|
| 7,098,769 | B2 * | 8/2006 | Ott | G01S 13/84 340/10.4 |
| 7,292,137 | B2 * | 11/2007 | Gilbert | B60R 25/24 307/10.1 |
| 7,444,118 | B2 | 10/2008 | Boh et al. | |
| 7,466,219 | B2 * | 12/2008 | Ishimura | B60R 25/24 340/435 |
| 7,545,254 | B2 * | 6/2009 | Brillon | B60R 25/245 340/10.2 |
| 7,791,457 | B2 * | 9/2010 | Ghabra | B60R 25/24 340/426.36 |
| 8,620,394 | B2 | 12/2013 | Sebastiano et al. | |
| 8,930,045 | B2 * | 1/2015 | Oman | G01S 13/765 340/426.36 |
| 8,976,005 | B2 * | 3/2015 | Zivkovic | G07C 9/00111 340/5.61 |
| 9,020,441 | B2 * | 4/2015 | Koga | H04W 24/00 455/67.11 |
| 9,035,757 | B2 * | 5/2015 | Nishidai | B60R 25/00 307/10.2 |
| 9,292,984 | B2 * | 3/2016 | Kitahara | G07C 9/00309 |
| 9,379,841 | B2 * | 6/2016 | Fine | H04K 3/86 |
| 2003/0071717 | A1 * | 4/2003 | Hagl | B60R 25/24 340/5.61 |
| 2006/0044108 | A1 * | 3/2006 | Nowottnick | B60R 25/24 340/5.61 |
| 2006/0077042 | A1 * | 4/2006 | Hock | B60R 25/24 340/10.4 |
| 2006/0255909 | A1 * | 11/2006 | Pavatich | B60R 25/24 340/5.64 |
| 2012/1015219 | | 5/2012 | Kofler | |
| 2013/0116964 | A1 * | 5/2013 | van Roermund | G06K 7/0008 702/141 |
| 2013/0214732 | A1 | 8/2013 | Nowottnick | |
| 2014/0169193 | A1 * | 6/2014 | Eder | H04L 43/08 370/252 |
| 2014/0220888 | A1 * | 8/2014 | Shimshoni | H04B 5/0056 455/41.1 |
| 2014/0303811 | A1 * | 10/2014 | Ledendecker | G07C 9/00944 701/2 |

OTHER PUBLICATIONS

Poturalski et al., "Distance Bounding with IEEE 802.15.4a: Attacks and Countermeasures", IEEE Transactions on Wireless Communications, vol. 10, No. 4, Apr. 2011.

Poturalski et al., "On Secure and Precise IR-UWB Ranging", IEEE Transactions on Wireless Communications, vol. 11, No. 3, Mar. 2012.

AMS, AS3932 Datasheet—Applications "3D Low Frequency Wakeup Receiver", Revision 1.7, pp. 1-34, www.ams.com/LF-Receiver/AS3932.

M. van Elzakker et al., "A 10-bit Charge-Redistribution ADC Consuming 1.9uW at 1 MS/s," IEEE JSSC, May 2010.

I.-Y. Lee et al., "A Fully Integrated TV Tuner Front-End with 3.1 dB NF, >+31dBm OIP3, >83dB HRR3/5 and >68dB HRR7," IEEE ISSCC, 2014.

Harpe et al., "A 0.47-1.6 mW 5-bit 0.5-1 GS/s Time Interleaved SAR ADC for Low-Power UWB Radios," IEEE JSSC, Jul. 2012.

J. van Sinderen et al., "Wideband UHF ISM-Band Transceiver Supporting Multichannel Reception and DSSS Modulation," IEEE ISSCC, 2013.

* cited by examiner

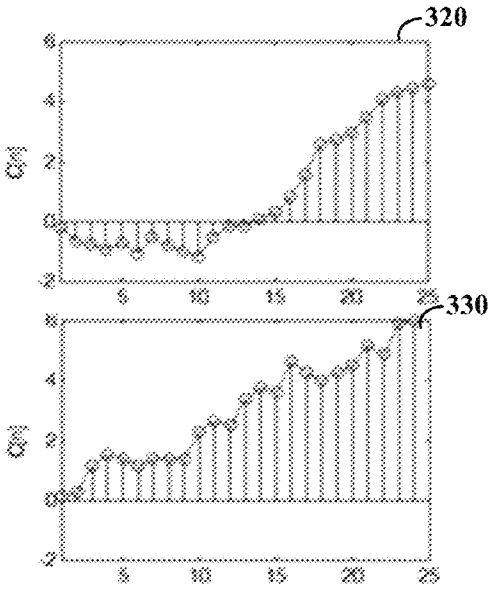
FIG. 3B
FIG. 3C
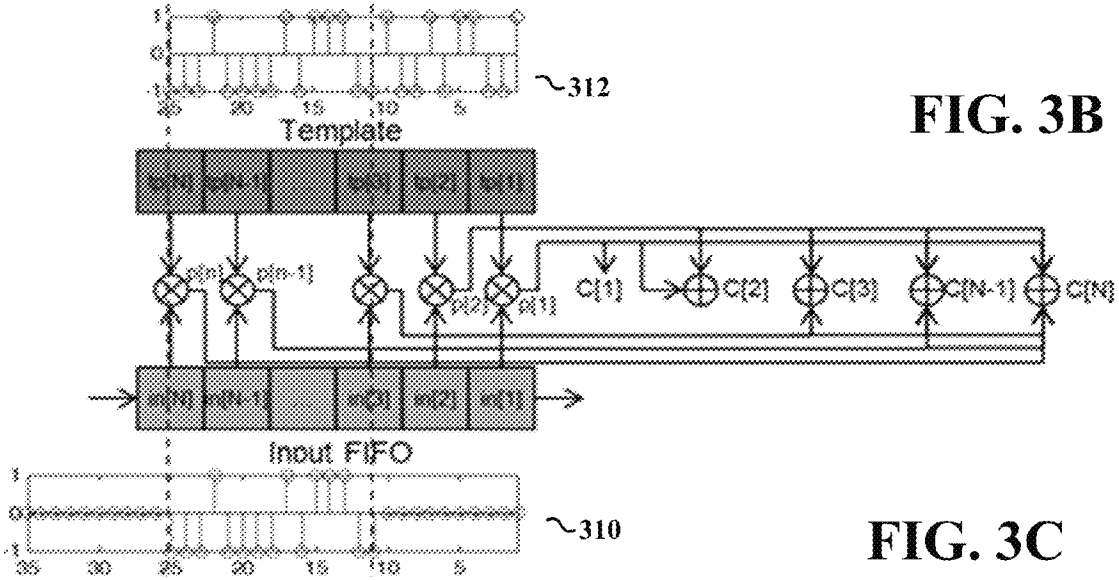
FIG. 3A

COMMUNICATIONS WITH INTERACTION DETECTION

Aspects of various embodiments are directed to communication of data and in which interaction with the communication is detected.

Many applications involve detecting a distance between communicating devices synchronization and authentication, which have been implemented using a multitude of approaches. For instance, radio frequency (RF) ranging systems often employ a time-of-flight principle to determine a distance between two objects, or markers on objects, that are communicating between one another. Proximity can be used from a security and authentication perspective, such as by ensuring that a remote device to be connected to a local device is within a predetermined threshold distance of the local device (e.g., to prevent unwanted connections to other devices in relative proximity). Security information can also be communicated, in connection with the time-of-flight communication. In vehicle-key systems, the vehicle can be unlocked if it is determined that the key is close. In other systems, proximity is used to ensure that the communication is between the two truly close-by devices.

Relay attacks can be performed by intercepting communication symbols and replaying at least a portion of the symbols. This is possible on encrypted communication without knowing anything about the content. These attacks can be used to gain access to a vehicle or other aspects relating to the intercepted communication.

These and other matters have presented challenges to communications, such as those involving time-of-flight/distance-based authentication, for a variety of applications.

Various example embodiments are directed to communicating a signal waveform, having a data symbol with a leading portion and authentication information therein, between a first remote circuit and a second local circuit via which authenticated vehicle access is facilitated. These embodiments are amenable, for example, to implementation to detecting interaction with a remote keyless entry system by an attacker attempting to gain unauthorized access to a vehicle. For instance, such an attacker may attempt to accelerate receipt of the signal at the vehicle, which may make a remote transponder appear closer to the vehicle than the transponder really is. At the local circuit, interaction with the signal waveform, by a third circuit, as transmitted from the remote circuit, is identified by detecting variations in characteristics of the leading portion of the data symbol, relative to known characteristics of the leading portion of the data signal.

A condition indicative of whether the signal waveform has been interacted with and retransmitted is determined or otherwise identified when the detected variations in characteristics are indicative of a known type of variation induced by interaction and retransmission. An output signal is generated which provides vehicle access based on the determined condition. In this context, attack attempts, such as those discussed above, can be detected based on interactions between the attacker and the signal. Further, such an approach can be carried out in a manner that is tolerant of noise within a signal waveform, by distinguishing variations due to noise from variations due to attacker interaction.

Another embodiment is directed to an apparatus having a first communication circuit, a second detection circuit and a third output circuit. The first communication circuit communicates a signal waveform, having a data symbol with a leading portion and authentication information therein, between a remote circuit and a local circuit via which authenticated vehicle access is facilitated. The second detection circuit detects interaction, by a third circuit, with the signal waveform transmitted from the remote circuit by detecting variations in characteristics of the leading portion of the data symbol relative to known characteristics of the leading portion of the data signal.

A condition indicative of whether the signal waveform has been interacted with and retransmitted is then determined in response to the detected variations in characteristics being indicative of a known type of variation induced by interaction and retransmission. The third output circuit generates an output signal that provides vehicle access based on the determined condition.

Another embodiment is directed to an apparatus (e.g., or system) including a remote communication circuit that communicates data for accessing a vehicle, and a vehicle access circuit that operates with the remote communication circuit to control locking of an entry door to the vehicle. A signal waveform corresponding to a signal transmitted by the remote communication circuit is detected, the signal waveform having a data symbol with a leading portion and authentication information therein. Variations in characteristics of the leading portion of the data symbol are compared, relative to known characteristics of the leading portion of the (intended/uninterrupted) signal waveform.

A condition indicative of whether the signal waveform has been interacted with and retransmitted is determined, based on the comparison of the variations in characteristics indicating a known type of variation induced by interaction and retransmission. An output signal that controls locking of the entry door is generated based on the determined condition.

The above discussion/summary is not intended to describe each embodiment or every implementation of the present disclosure. The figures and detailed description that follow also exemplify various embodiments.

BRIEF DESCRIPTION OF FIGURES

Various example embodiments may be more completely understood in consideration of the following detailed description and in connection with the accompanying drawings, in which:

FIGS. 3A-3C show an approach for detecting an attack with regard to a cumulative sum, in accordance with another embodiment.

Figure 1A:
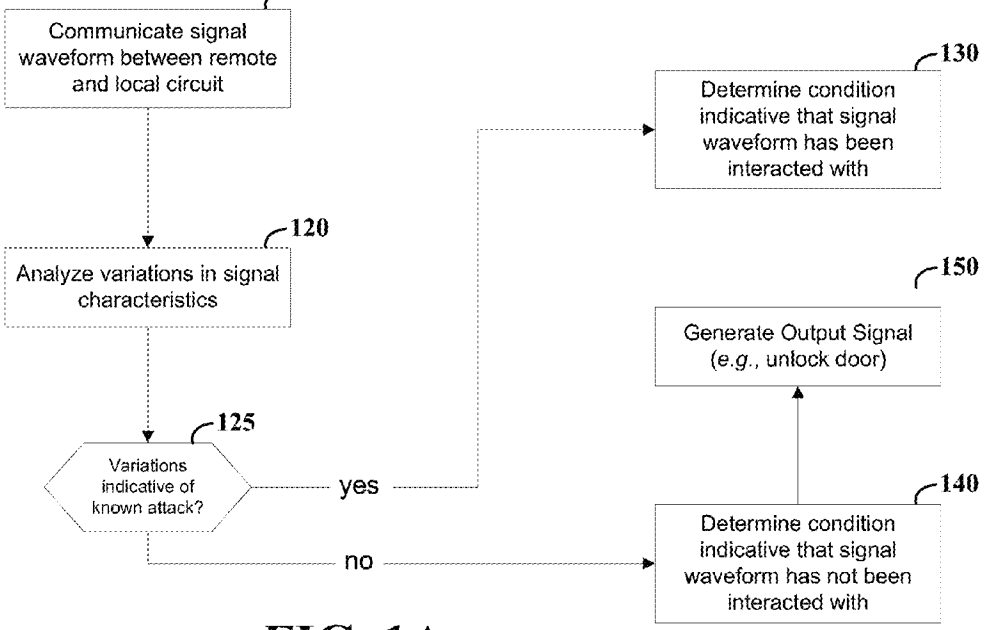
FIGS. 1A-1C show an approach to mitigating cross-correlation attacks, in accordance with various embodiments.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as may be used throughout this application is by way of illustration, and not limitation.

DETAILED DESCRIPTION

Aspects of the present disclosure are believed to be applicable to a variety of different types of apparatuses, systems and methods involving authentication of communications, mitigating interference with communications, and to interference-type attacks that may result in detectable changes in a signal waveform. In certain implementations, aspects of the present disclosure have been shown to be beneficial when used in the context of detecting relay attacks for remote vehicle access, such as for keyless entry or keyless go (e.g., energizing a vehicle drive system). While not necessarily so limited, various aspects may be appreciated through a discussion of examples using such exemplary contexts.

According to various example embodiments, aspects of the present disclosure are directed to facilitating time-of-flight distance bounding protocols for secure communication, such as to detect so-called "Early detect-late commit" relay attacks. Such attacks may be implemented with communication symbol detectors (e.g., matched filter) to signal shape deviation and interference. This type of attack can result in a detected distance being shorter than an actual distance, where the attacker detects the start of a symbol and then emits a tail of the symbol. The received symbol (e.g., at a vehicle communication circuit) therefore is missing the first part of the regular symbol. This type of attack is possible even if the symbol sequence is encoded. Deviations in the start of the symbol are detected and used to detect (and, e.g., prevent) relay attacks, which can be carried out on a physical level. In various implementations, distance bounding is based on a sequence of symbols. Such embodiments may provide detection of interaction/attacks with encrypted symbol sequences in which the attack is performed using known symbol shapes, based on symbol shape deviation, and can be implemented to detect a number of unpredictable symbols. For instance, attacks can be detected for time-of-flight distance bounding protocols involving IEEE 802.15.4 or ISO/IEC 24730 CSS.

Certain embodiments employ knowledge of a limit upon which a physical distance can be made to appear shorter by the relay attack, as may depend on the length of the symbols and the speed at which the communications are made. A symbol detector, such as a matched filter, can be used in a manner that is robust to missing symbol parts and interference, and the start of symbol deviation introduced during a relay attack is detected relative to other signal modifications, such as those due to interference.

Various embodiments are directed to mitigating attacks in scenarios involving a matched filter (e.g., with a cross correlation approach) on input signal and template signal, which provides a measure of similarity between the respective signals. This measure of similarity can be used to detect the presence and position of a certain sequence inside a received signal stream. When the output of a correlator is beyond some threshold, the template signal can be considered as found in the input signal. Such a matched filter can be used to enhance a signal-to-noise ratio (SNR) in the presence of additive stochastic noise. By definition, for signal x(t) and template signal tp (t), the cross-correlation function between a template and partial sequence is given by the following equation.

$$R(t)=x(t)*tp*(-t)=\int_{-\infty}^{+\infty}x(\tau)\cdot tp*(\tau-t)d\tau$$

If the input signal is only part of the template signal rather than the whole one, cross-correlation will still generate a peak with less magnitude and earlier in time. This peak is proportional to the ratio between the partial input signal and the whole template and might still be high enough to be recognized as a match.

Figure 1B:
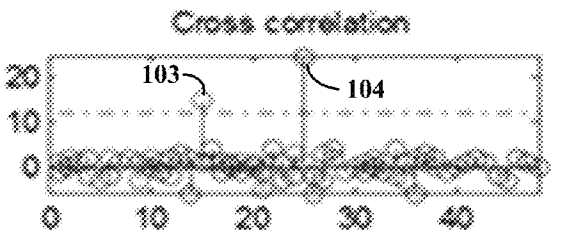
Figure 1C:
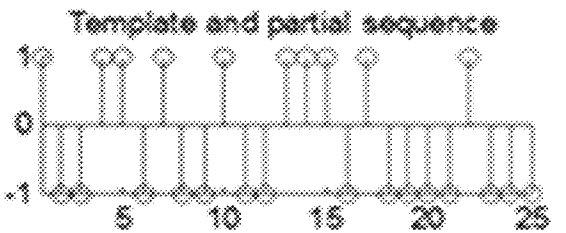

Turning now to the figures, FIGS. 1A-1C show an approach to mitigating cross-correlation attacks, in accordance with another example embodiment. The insets 101 and 102 illustrated by FIGS. 1B and 1C show an example implementation in which an input signal includes part of a template signal, in which a peak is generated with a discrete version of cross-correlation. The sequence in inset 102 includes an initial portion from 0-10 that is a template, with the portion thereafter being an input signal. Inset 101 shows a cross-correlation result with a peak 103 and an autocorrelation function of the template itself with a peak 104. Due to the partial similarity between the input signal and template, a peak is still generated when the input is overlapped with the corresponding part of the template. Though not as high as the peak in the autocorrelation function, it is still higher than a threshold (shown as a dashed line), which may cause recognition as a match. Further, the peak 103 occurs earlier than the peak 104, which means a matched filter based detection block will identify the presence of the input of a partial symbol earlier than a full sequence of a normal symbol signal, thus resulting a shorter time-of-flight and related distance calculation. Due to the presence of noise and actual setting of decision threshold, the correlation peak generated by the partial sequence might be lower than the threshold which will result in a failure in a ranging session or an increased bit error rate (BER) in data communication.

Interference in such a scenario can be mitigated as follows and as illustrated by FIG. 1A. At block 110, a signal waveform is communicated between a remote circuit and a local circuit (e.g., with the remote circuit operating as a transponder and the local circuit being within a vehicle and via which authenticated vehicle access is facilitated). The signal waveform has a data symbol with a leading portion and authentication information therein. Interaction by a third circuit with the signal waveform transmitted from the remote circuit is detected as follows. At block 120, variations in characteristics of the leading portion of the data symbol are analyzed relative to known characteristics of the leading portion of the data signal. If the variations are indicative of a known attack, a condition indicative of whether the signal waveform has been interacted with and retransmitted is determined at block 130. If the variations are not indicative of a known attack, a condition indicative that the signal waveform has not been interacted with and retransmitted is determined at block 140. At block 150, an output signal is generated, which provides vehicle access based on the determined condition.

In some implementations, the signal waveform is known and fixed, with different signal forms corresponding to different symbols. The order of the symbols is encrypted such that an attacker needs to detect the order before retransmitting.

Figures 2A, 2B:
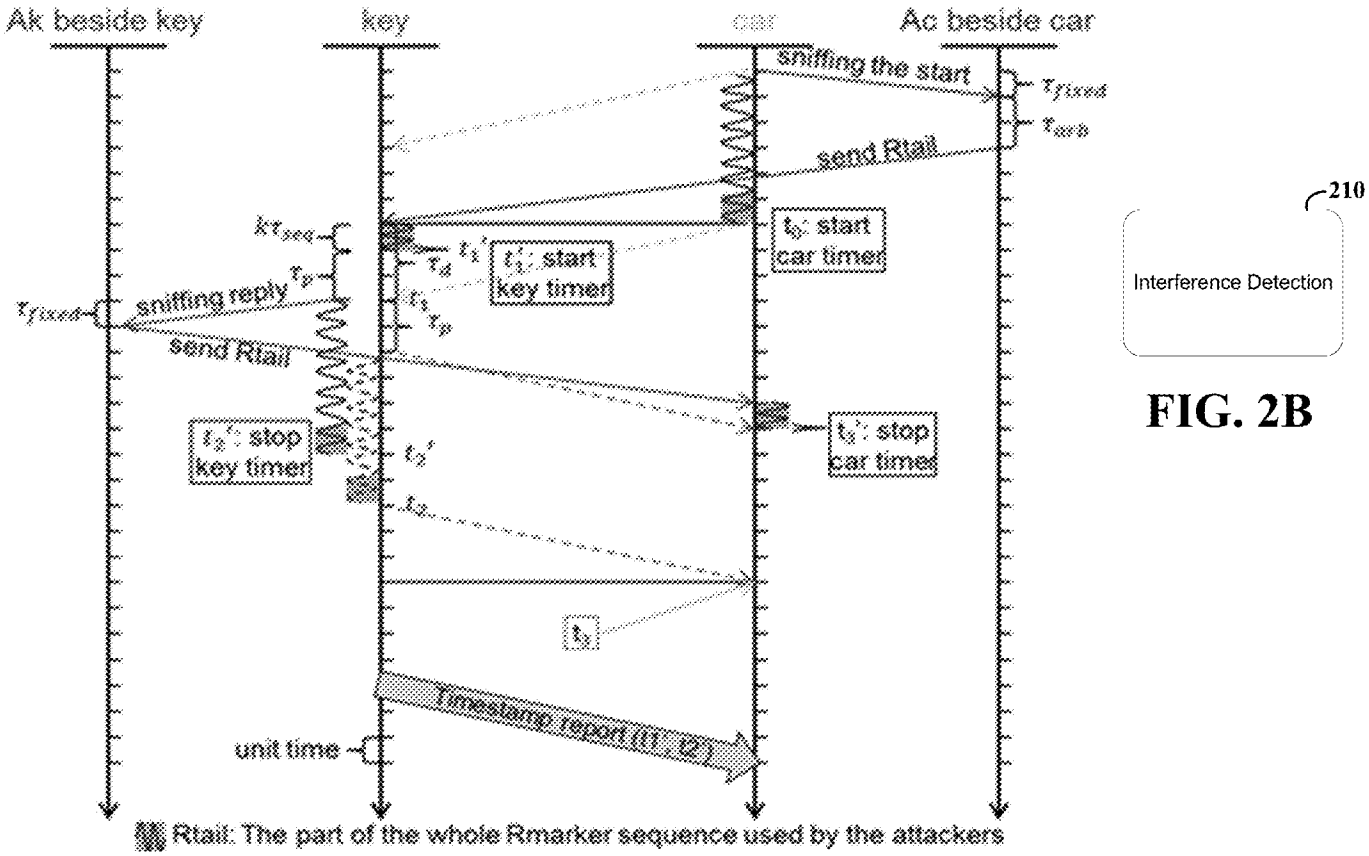
FIGS. 2A-2B show an embodiment in which interaction is detected with two attackers, as may be implemented in accordance with one or more embodiments.

FIGS. 2A-2B show an embodiment in which interaction is detected with two attackers, as may be implemented with various embodiments. Interference detection may be carried out, as illustrated by FIG. 2B, at block 210, as may be implemented within a vehicle (car) as shown, and as may be used to detect partial sequence correlation. Normal (non-attack) operation shown is shown in dashed lines. An attacker (Ac) is shown beside the car while another (Ak) is shown as being close to a key (e.g., that an owner of the car may carry away from the car). The car periodically sends a message Rmsg which is intercepted by Ac. Early Detection is used by Ac to perform quick detection on the Rmsg, and may be limited by the minimum equipment delay of $\tau_{fixed}$. In some implementations, Ac adds arbitrary delay $\tau_{arb}$ following $\tau_{fixed}$. Ac sends a tail part (Rtail) of the Rmsg with a length $k\tau_{seq}$. Though short, this Rtail might still generate a peak high enough in the key (e.g., in an ACQ/SYNC detection block) to be recognized as a proper Rmsg which exploits the correlation effect discussed above.

At $t'_1$ the key starts its timer and after some processing time $\tau_p$ it starts to send back an Rmsg. This Rmsg will be detected by Ak with the same method used by Ac in the beginning and Rtail is sent to the car immediately after the equipment delay $\tau_{fixed}$. This Rtail may otherwise cause the car to operate as if an Rmsg is detected, and stop its timer at $t'_3$. According to Eq. 1, the distance measured by the car is calculated in the following way:

$$D' = \frac{1}{2}(\tau_{car} - \tau_{key})c = \frac{1}{2}[(t'_3 - t_0) - (t'_2 - t'_1)]c$$
$$= (\tau_d + \tau_{fixed} + (k-1)\tau_{seq} + 0.5\tau_{arb})c$$

So the distance reduced by the attack is:

$$\Delta D = D - D' = [(1-k)\tau_{seq} - 0.5\tau_{arb} - \tau_{fixed}]c$$

Where D is the distance measured by the car in the normal operation. When k is approaching zero, the Rtail is merely a strong pulse and the distance reduction reaches its maximum value which is $(\tau_{seq} - 0.5\tau_{arb} - \tau_{fixed})c$. If the attacker's equipment delay and arbitrary delay are neglected, the theoretical upper bound of distance reduction is:

$$\Delta D_{max} = \tau_{seq} c$$

To distinguish between normal operation and attack, features are used as decision criterion. In one embodiment, a cumulative correlation (CC) feature is used. The attack detection is done at the peak of the correlation $R[n]_{n=N_p}$ where the partial sequence is recognized by the correlator in the receiver as a predefined Rmarker. The cross correlation is expanded at $N_p$ and the cumulative sum of the products is computed as the CC, which is defined as:

$$C[m] = \Sigma_{n=1}^{m} tp[n] \cdot in[n]$$

Here, C[N] is the cross-correlation between in[n] and tp[n] at this specific moment, and assumes the system uses bipolar sequences that contain −1 and +1. In normal operation, the received signal is sampled and stored in the input FIFO and the cross-correlation is maximized when an input FIFO sequence is the same (corrupted by noises) with a template. Each product is relatively maximized towards +1 (1×1=1, −1×−1=1). Accordingly, the C[n] curve is monotonic and increasing with a relatively fixed slope.

In connection with one or more embodiments, it has been discovered/recognized that, while the cross-correlation C[N] may be above the decision threshold when an attack occurs, the cumulative sum may not increase with constant slope. This can be used to identify variations in a signal as being due to interference and/or retransmission.

Referring to FIGS. 3A-3C, an approach is shown for detecting an attack with regard to a cumulative sum as above. An input FIFO receives an input signal 310 which can be compared with a template signal 312, as illustrated by FIG. 3A. Part of a forged signal may simply be random noise, such as when an attacker sends Os or randomly guessed values, which tends to cancel. The CC curve will first be relatively flat and then increase with a smaller slope. This feature is graphically represented in insets 320 and 330 as illustrated by FIGS. 3B and 3C respectively under attack and normal scenarios, by way of example using the same full sequence (of length 25) and partial sequence in FIG. 1A. In normal operation, when a symbol is detected based on the cross-correlation peak, the C[n] curve may resemble the inset 330, while inset 320 shows a first-flat CC curve under an LC attack. Attack detection can thus involve distinguishing between two kinds of CC curves or CC features.

In various implementations, a CC curve threshold approach is used to detect an attack. A threshold is used with a C[n] curve to identify variations, such as an abnormal knee in the curve shape. An algorithm as followed is carried out:

Choose a threshold $C_{th}$;

Choose a sample index q;

If $C[q] \geq C_{th}$ then

Accept symbol and range measurement;

Else

Reject symbol and range measurement.

The choice of $C_{th}$ and q may be implemented to influence detection performance. A large $C_{th}$ may be used to eliminate most of the attack symbols while also making the chance of rejecting a normal symbol higher due to the presence of noise. A lower/minimum detectable distance reduction is determined by q, in which a smaller q results in detection based on fewer received samples, and the usable LC time is less for the attacker. If a perfect down conversion and automatic gain control (AGC) are assumed, after analog-digital conversion and sampling, a discrete version of a demodulated signal is obtained as:

$$S_{nor}[n] = TP[n] + N[n]$$

where N[n] is additive Gaussian noise from the channel with zero mean and a variance of $\sigma^2$. TP and N can be regarded as two independent random processes. For a certain n, TP[n] is a discrete random variable with PMF of p (TP[n]=1)=p (TP[n]=−1)=0.5 and N[n] is a discrete random variable with Gaussian distribution N(0, $\sigma^2$). In baseband, a symbol is correlated with the template TP [n] in a ranging engine and at the correlation peak, CC is obtained:

$$C_{nor}[m] = \sum_{n=1}^{m} S_{nor}[n] \cdot TP[n] = \sum_{n=1}^{m} (TP[n] + N[n]) \cdot TP[n] \quad (1.)$$

Again C[m] is random variable as a function of TP[n] and N[n] and the expected value of the random variable, or E{C[m]} is:

$$E\{C_{nor}[m]\} = E\{\Sigma_{n=1}^{m}(TP[n]+N[n]) \cdot TP[n]\} = \Sigma_{n=1}^{m}\{E\{TP[n] \cdot TP[n]\} + E\{N[n] \cdot TP[n]\}\} \quad (2.)$$

For binary symbol sequence of +1 and −1, TP[n]·TP[n]≡1. N[n] and TP[n] are independent and TP[n] is a balanced sequence (the chance of 1 and −1 are equal), so E{N[n]·TP[n]}=E{N[n]}·E{TP[n]}=0. Then Equation 2.) reduces to: $E\{C_{nor}[m]\}=m$ The variance of random variable $C_{nor}[m]$ is:

$$Var\{C_{nor}[m]\} = Var\{\sum_{n=1}^{m} TP[n] \cdot TP[n] + N[n] \cdot TP[n]\} = \Sigma_n Var\{N[n] \cdot TP[n]\} + \Sigma_n \Sigma_{l \neq n} Cov\{N[n] \cdot TP[n], N[l] \cdot TP[l]\}$$

Because the two terms in the covariance are independent and N [n] and TP [n] are independent, the above equation reduces to:

$$Var\{N[n]\cdot TP[n]\} = Var\{N[n]\}Var\{TP[n]\} + Var\{N[n]\}E^2\{TP[n]\} + Var\{TP[n]\}E^2\{N[n]\}$$
$$= \sigma^2 \times 1 + 0 + 0 = \sigma^2$$

Then:

$$\mathrm{Var}\{C_{nor}[m]\}=\Sigma_{n=1}^{m}\mathrm{Var}\{N[n]\cdot TP[n]\}=m\cdot\sigma^2$$

An alternative deduction can lead to the same above result and provide distribution information of $C_{nor}[m]$. When m is large which is to say the symbol spreading sequence is long, $C_{nor}[m]=\Sigma_{n=1}^{m}G[n]$ is a summation of large numbers of i.i.d. random variables where $G[n]=S_{nor}[n]$. TP[n]. According to Central Limit Theorem, $C_{nor}[m]$ is Gaussian-distributed with mean of nE{G[n]} and variance of nVar{G[n]} which lead to the same expected value and variance in the above deduction. In summary, Cumulative Correlation under normal operation fulfils:

$$C_{nor}[m]\sim N(m,m\sigma^2)$$

In attack operations, the input signal becomes:

$$S_{att}[n]=u[n-K]TP[n]+N[n]$$

where u[n] is a step function and K is a Late Commit delay expressed in sample counts used by the attacker. The cumulative correlation function under attack becomes:

$$C_{att}[m] = \begin{cases} (m-K) + \sum_{n=1}^{m} N[n]\cdot TP[n] & m > K \\ \sum_{n=1}^{m} N[n]\cdot TP[n] & m \le K \end{cases}$$

The expected value of $C_{att}[M]$ is:

$$E\{C_{att}[m]\} = \begin{cases} (m-K) & m > K \\ 0 & m \le K \end{cases}$$

According to the previous discussions: $\mathrm{Var}\{C_{att}[m]\}=m\cdot\sigma^2$ Under attack operation:

$$C_{att}[m] \sim \begin{cases} N((m-K), m\sigma^2) & m > K \\ N(0, m\sigma^2) & m \le K \end{cases}$$

From the above discussion, both distribution under normal operation and attack operation are Gaussian and the variance is the same under two different conditions. The expected value is proportional to a partial sequence length the attack uses, which can be determined in consideration of an accumulation of the energy in the sequence with the variance from the accumulation of the AWGN. The distance between the two expected values under normal and attack operation may be a constant K after the $K^{th}$ term.

Another embodiment is directed to an approach involving the use of a likelihood ratio. An algorithm as follows may be implemented in this context:

Choose a threshold μ;

Compute the likelihood ratio $\lambda=p(\vec{C}|H_1)/p(\vec{C}|H_2)$;

If $\lambda\geq\mu$ then

Accept symbol and range measurement;

Else

Reject symbol and range measurement.

The above algorithm may be implemented for K values smaller or equal to q, such as when an attacker's LC delay is known to the system. However, attackers may choose arbitrary length of LC delay for an attack sequence thus making it difficult or impossible to determine an appropriate q for the above algorithms in advance. Such scenarios may be addressed as follows.

Normal operation and attack operation are represented by $H_1$ and $H_2$ respectively. Two likelihood functions are $p(\vec{C}|H_1)$ and $p(\vec{C}|H_2)$ where $\vec{C}=(C_1, C_2, \ldots C_N)$. From previous discussion, $$p(C_1|H_1)=N(\mathbf{1},\rho^2)$$

and according to Bayes theorem, we have:

$$p(C_1,C_2|H_1)=p(C_2|C_1,H_1)\cdot p(C_1|H_1)$$

in which $p(C_2|C_1, H_1)$ represents, under normal operation, when $C_1$ is observed, the probability density function of $C_2$. In addition, $C_1$ is now regarded as a constant number and it has a linear relationship with $C_2$:

$$C_2=C_1+1+n_2$$

where 1 results from the correlation operation between input sequence and the template. $n_2\sim N(0, \sigma^2)$ is the noise. A shifted Gaussian distribution relates as follows:

$$p(C_2|C_1,H_1)=N(1+C_1,\sigma_2)$$

Similarly $p(C_3|C_2, C_1, H_1)=N(1+C_2,\sigma^2)$, and $$p(C_N \mid C_{N-1}, C_{N-2}, \ldots, C_1, H_1) = N(1 + C_{N-1}, \sigma^2) = \frac{1}{\sigma\sqrt{2\pi}}\exp - \frac{(C_N - (C_{N-1}+1))^2}{2\sigma^2}$$

Using the chain rule of conditional probability:

$$p(\vec{C} \mid H_1) = p(C_N \mid C_{N-1}, C_{N-2}, \ldots, C_1, H_1)\cdot p(C_{N-1} \mid C_{N-2}, \ldots, C_1, H_1)\cdot \ldots \cdot p(C_1 \mid H_1) = \left(\frac{1}{\sigma\sqrt{2\pi}}\right)^N \prod_{i=1}^{N} \exp\left(-\frac{(C_i - C_{i-1} - 1)^2}{2\sigma^2}\right)$$

where $C_0=0$. Taking a natural logarithm of both side of the equation, the log-likelihood is:

$$\log(p(\vec{C} \mid H_1)) = N\log\frac{1}{\sigma\sqrt{2\pi}} + \sum_{i=1}^{N} -\frac{(C_i - C_{i-1} - 1)^2}{2\sigma^2}$$

Similarly, under attack operation with certain K value, we have:

$$p(\vec{C} \mid H_2, K) = \left(\frac{1}{\sigma\sqrt{2\pi}}\right)^N \cdot \exp\left(\frac{-(C_1 - C_0)^2}{2\sigma^2}\right)$$

-continued $$\ldots \exp\left(\frac{-(C_K - C_{K-1})^2}{2\sigma^2}\right) \cdot \exp\left(\frac{-(C_{K+1} - C_K - 1)^2}{2\sigma^2}\right) \ldots \exp\left(\frac{-(C_N - C_{N-1} - 1)^2}{2\sigma^2}\right)$$

And the corresponding log-likelihood is:

$$\log(p(\vec{C} \mid H_2, K)) = N\log\frac{1}{\sigma\sqrt{2\pi}} + \sum_{i=1}^{K} -\frac{(C_i - C_{i-1})^2}{2\sigma^2} + \sum_{i=K+1}^{N} -\frac{(C_i - C_{i-1} - 1)^2}{2\sigma^2}$$

The difference between the two log-likelihood is:

$$\log(p(\vec{C} \mid H_1)) - \log(p(\vec{C} \mid H_2, K)) = \sum_{i=1}^{K} \frac{2(C_i - C_{i-1}) - 1}{2\sigma^2}$$

or equivalently:

$$p(\vec{C} \mid H_2, K) = p(\vec{C} \mid H_1) \cdot \exp\left(\sum_{i=1}^{K} \frac{-2(C_i - C_{i-1}) + 1}{2\sigma^2}\right)$$

Applying total probability theorem to $p(\vec{C}|H_2)$:

$$p(\vec{C} \mid H_2) = \sum_{K=1}^{N} p(\vec{C} \mid H_2, K) \cdot p(K) = \sum_{K=1}^{N} \left[p(\vec{C} \mid H_1) \cdot \exp\left(\sum_{i=1}^{K} \frac{-2(C_i - C_{i-1}) + 1}{2\sigma^2}\right)\right] \cdot p(K)$$

p(K) is the probability mass function of the LC length that the attacker chooses. Assuming an attacker may use all possible LC delay length K with equal chance, means p(K)=1/N where N is the normal sequence length. The inner summation terms will cancel each other and give:

$$p(\vec{C} \mid H_2) = \frac{1}{N} p(\vec{C} \mid H_1) \sum_{K=1}^{N} \exp\left(\frac{-2C_K + K}{2\sigma^2}\right)$$

The likelihood ratio is:

$$\lambda = \frac{p(\vec{C} \mid H_1)}{p(\vec{C} \mid H_2)} = \frac{N}{\sum_{K=1}^{N} \exp\left(\frac{-2C_K + K}{2\sigma^2}\right)}$$

In some implementations in which an attacker LC delay length K is known, $p(\vec{C}|H_2)$ reduces to:

$$p(\vec{C} \mid H_2) = \sum_{K=1}^{N} p(\vec{C} \mid H_2, K) \cdot p(K) = p(\vec{C} \mid H_2, K_{known}) \cdot 1$$

-continued $$= p(\vec{C} \mid H_1) \cdot \exp\left(\frac{-2C_{K_{known}} + K_{known}}{2\sigma^2}\right)$$

The likelihood ratio is then:

$$\lambda_K = \frac{p(\vec{C} \mid H_1)}{p(\vec{C} \mid H_2)} = \frac{1}{\exp\left(\frac{-2C_{K_{known}} + K_{known}}{2\sigma^2}\right)}$$

Under this case, similar to algorithms above, the judgment parameter (λ, C[q] or d[q]) depends on one term in C [m] or d [m] sequence.

Another embodiment involves multiple symbol protocols and detection. Such an approach may be implemented for distance measuring and detection of a possible attack on a single symbol, and with communication messages having multiple symbols that are encrypted and having a sequence that is difficult to predict. The likelihood of the detection of the attack, and in that way the protection, can be increased by detecting the attack and detecting (e.g., estimating) distance traveled on each of the symbols of the message.

An example distance bounding protocol is carried out as followed. First, a distance measurement is carried out on each symbol in an encrypted sequence. For example let there be M symbols and M distance measurements $d_1, \ldots, d_M$. Actual distance is computed as some combination of the M measured distances. For example a median value of the M measurements can be taken as a robust estimate of the distance. If the symbol sequence is not predictable, this may force an attacker to perform a relay attack on multiple symbols, increasing the chance of detection. Detection is performed on all message symbols if the distance is small for an action to be performed (e.g., to open a car door if a measured distance is less than 2m). An above described attack detection can be applied.

Using this approach, the chance for detecting the attack will increase in this way. For example let the chance for not detecting the attack on a single symbol be as large as 0.3 (that means 30% chance of attack to succeed) and false alarm rate be 1/10^6. If the sequence has 10 symbols the chance of the successful attack will reduce to 0.3^10~5e-6, while the false detection rate will increase only to 1/10^5. This can be even further improved by modeling a complete multiple symbol sequence for detection, as an extension of the algorithms described above.

In some implementations, due to multipath measurements some of the distances may appear larger than the median measured distance. An attacker might attack only a few symbols such that they are smaller than the median distance but the median distance will still be large and correct. Smaller than median measurements can be used as an indication of such unsuccessful relay attack on a small number of the message symbols.

In some embodiments, additional protection is achieved based on the physical limitations and attacker inaccuracy. In certain implementations, a measured/estimated distance may be negative, which fails the attacks, where the following holds:

$$D_{real} - D_{fake} < \Delta D < D_{real} \quad (3.)$$

where $D_{real}$ is the real distance between the key and the car and $D_{fake}$ is the attacker's desired fake distance. We have:

$$\begin{cases} k > 1 - \dfrac{D_{real} + (0.5\tau_{arb} + \tau_{fixed})c}{c\tau_{seq}} \\ k < 1 - \dfrac{D_{real} - D_{fake} + (0.5\tau_{arb} + \tau_{fixed})c}{c\tau_{seq}} \end{cases}$$

Translate the range of k to time by multiplying the length of the Rmsg:

$$\Delta k \cdot \tau_{seq} = \frac{D_{fake}}{c}$$

Using the example in which an attacker intends to steal a car by convincing the system that its owner is just 1 meter away while the owner is actually 100 meters away and the ranging system uses 500 ns long Rmsg, $D_{real}$=100m and $D_{fake}$=1 m which results in 0.3329<k<0.3395. This is equivalent to 1m/c=3 ns timing accuracy. If the attacker is not so ambitious, let's say for a fake distance of 10 meters, then we have 0.3329<k<0.3996 which is equivalent to 10/c=30 ns timing accuracy.

Various example embodiments are directed to communicating a signal waveform, having a data symbol with a leading portion and authentication information therein, between a first remote circuit and a second local circuit via which authenticated vehicle access is facilitated. These embodiments are amenable, for example, to implementation to detecting interaction with a remote keyless entry system by an attacker attempting to gain unauthorized access to a vehicle. For instance, such an attacker may attempt to accelerate receipt of the signal at the vehicle, which may make a remote transponder appear closer to the vehicle than it really is. At the local circuit, interaction with the signal waveform, by a third circuit, as transmitted from the remote circuit is identified by detecting variations in characteristics of the leading portion of the data symbol, relative to known characteristics of the leading portion of the data signal. A condition of the signal waveform indicative of whether the signal waveform has been interacted with and retransmitted is determined or otherwise identified when the detected variations in characteristics are indicative of a known type of variation induced by interaction and retransmission. An output signal is generated which provides vehicle access based on the determined condition. For instance, the output signal may be generated for unlocking an entry door to the vehicle when the determined condition is not indicative of interaction and retransmission. In this context, attack attempts such as those discussed above can be detected based on interactions between the attacker and the signal. Further, such an approach can be carried out in a manner that is tolerant of noise within the signal waveform, by distinguishing variations due to noise from variations due to attacker interaction.

The condition of the signal waveform and related authentication is determined in a variety of manners, to suit particular embodiments. In some embodiments, changes in the leading portion of the data symbol are compared with a retransmission profile that corresponds to changes induced by interaction and retransmission of the signal waveform. A distance between the first remote circuit and the second local circuit is determined based on the data symbol. The output signal is generated in response to both the determined distance being less than a predetermined threshold, and the changes in the leading portion of the data signal not matching the retransmission profile (i.e., indicative that the signal waveform has not been tampered with).

In other embodiments, determining the condition of the signal waveform involves distinguishing between noise-based variations in the signal waveform and the variations induced by interaction and retransmission. In some implementations, such an approach involves assessing a statistical component of the signal waveform relative to statistical components of known interaction and retransmission techniques. In other implementations, the signal waveform is cross-correlated with a template waveform and the variations are detected based on characteristics of the cross-correlation, relative to expected cross-correlation characteristics of the signal waveform. Another cross-correlating approach involves cross-correlating the signal waveform with a template waveform, computing a cumulative correlation as a sum of products of the cross-correlation, and detecting the variations as being induced by interaction and retransmission based on a slope of values of the cumulative correlation, relative to an expected slope of values of a cumulative correlation of the signal waveform.

In certain embodiments, the condition of the signal waveform is determined by cross-correlating the signal waveform with a template waveform, a cumulative correlation is computed as a sum of products of the cross-correlation (e.g., a set of intermediate values of the cross correlation), and the variations are detected based on the cumulative correlation. Cross-correlating in this context may, for example, include cross-correlating respective portions of each waveform pertaining to a common time period, and producing a product for each of the respective portions that are cross-correlated with one another. The cumulative correlation is then computed by summing the products.

Variations in characteristics of a leading portion of a data symbol can be detected using a variety of approaches. In some implementations, a position of a portion of the data symbol in which the detected variations occur is identified and the condition is determined based on the identified position. Further, detecting such variations may be carried out over a plurality of symbols, each of which is used in determining that the signal waveform has been interacted with and retransmitted.

In certain embodiments, a ratio is computed between a first likelihood function employing characteristics in the data symbol and a second likelihood function employing the known characteristics. A more particular embodiment involves computing a ratio between a first likelihood function employing characteristics in the leading edge and a second likelihood function employing the known characteristics. In either embodiment, the variations may be detected based on the computed ratio and a threshold indicative of variations. In a further implementation, the ratio is computed based on a probability mass function characterizing timing of interaction within the data symbol (e.g., of an unknown timing).

Another embodiment is directed to an apparatus having a communication circuit, a detection circuit and an output circuit. The communication circuit communicates a signal waveform, having a data symbol with a leading portion and authentication information therein, between a remote circuit and a local circuit via which authenticated vehicle access is facilitated. The detection circuit detects interaction, by another (e.g., attacker-operated) circuit, with the signal waveform transmitted from the remote circuit by detecting variations in characteristics of the leading portion of the data symbol relative to known characteristics of the leading portion of the data signal. The variations may, for example, be detected based upon a computed a ratio between a first likelihood function employing characteristics in the leading portion and a second likelihood function employing the known characteristics. A condition indicative of whether the signal waveform has been interacted with and retransmitted is then determined in response to the detected variations in characteristics being indicative of a known type of variation induced by interaction and retransmission. The output circuit generates an output signal that provides vehicle access based on the determined condition (e.g., by unlocking an entry door).

The detection circuit operates in a variety of manners, to suit particular embodiments. In some embodiments, changes in the leading portion of the data symbol are compared with a retransmission profile that corresponds to changes induced by interaction and retransmission of the signal waveform. A distance between the remote circuit and the second local circuit is determined based on the data symbol. The output signal is generated in response to both the determined distance being less than a predetermined threshold, and the compared changes not matching the retransmission profile. In this context, the output signal may be inhibited in response to the changes in the leading portion of the data symbol matching the retransmission profile.

In some embodiments, the apparatus distinguishes noise-based variations in the signal waveform from variations induced by interaction and retransmission by cross-correlating the signal waveform with a template waveform, computing a cumulative correlation as a sum of products of the cross-correlation, and detecting the variations based on the cumulative correlation.

Various blocks, modules or other circuits may be implemented to carry out one or more of the operations and activities described herein and/or shown in the figures. In these contexts, a "block" (also sometimes "logic circuitry" or "module") is a circuit that carries out one or more of these or related operations/activities (e.g., cumulative correlation, thresholding, or ratio comparison). For example, in certain of the above-discussed embodiments, one or more modules are discrete logic circuits or programmable logic circuits configured and arranged for implementing these operations/activities, as in the circuit modules shown in FIG. 1A. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, first and second modules include a combination of a CPU hardware-based circuit and a set of instructions in the form of firmware, where the first module includes a first CPU hardware circuit with one set of instructions and the second module includes a second CPU hardware circuit with another set of instructions.

Certain embodiments are directed to a computer program product (e.g., nonvolatile memory device), which includes a machine or computer-readable medium having stored thereon instructions which may be executed by a computer (or other electronic device) to perform these operations/activities.

Based upon the above discussion and illustrations, those skilled in the art will readily recognize that various modifications and changes may be made to the various embodiments without strictly following the exemplary embodiments and applications illustrated and described herein. For example, implementations described with keyless entry may be applied to keyless go (e.g., engaging a vehicle's drive system), or to other short-range communications such as with smart cards and other transaction-related communication. Such modifications do not depart from the true spirit and scope of various aspects of the invention, including aspects set forth in the claims.

What is claimed is:

1. A method comprising:

communicating a signal waveform, having a data symbol with a leading portion and authentication information therein, between a first remote circuit and a second local circuit via which access to a vehicle is facilitated;

at the local circuit, detecting interaction, by a third circuit, with the signal waveform transmitted from the first remote circuit by detecting variations in characteristics of the leading portion of the data symbol relative to characteristics of the leading portion of the signal waveform, determining a condition indicative of whether the signal waveform has been interacted with and retransmitted, in response to the detected variations in characteristics being indicative of a type of variation induced by interaction and retransmission; and generating an output signal that provides vehicle access based on the determined condition.

2. The method of claim 1, wherein the access to the vehicle includes controlled unlocking of an entry door to the vehicle;

wherein determining the condition includes comparing changes in the leading portion of the data symbol with a retransmission profile that corresponds to changes induced by interaction and retransmission of the signal waveform, further including determining a distance between the first remote circuit and the second local circuit based on the data symbol, and wherein generating the output signal based on the determined condition includes, generating the output signal in response to the determined distance being less than a predetermined threshold and the comparing of the changes in the leading portion of the data signal not matching the retransmission profile, and inhibiting the output signal in response to the changes in the leading portion of the data symbol matching the retransmission profile.

3. The method of claim 1, wherein characteristics of the leading portion of the signal waveform include expected characteristics of the signal waveform as uninterrupted by the third circuit, wherein determining the condition includes distinguishing between noise-based variations in the signal waveform and the variations induced by interaction and retransmission.

4. The method of claim 3, wherein distinguishing between noise-based variations in the signal waveform and the variations induced by interaction and retransmission includes assessing a statistical component of the signal waveform relative to statistical components of known interaction and retransmission techniques.

5. The method of claim 3, wherein distinguishing between noise-based variations in the signal waveform and the variations induced by interaction and retransmission includes cross-correlating the signal waveform with a template waveform and detecting the variations based on characteristics of the cross-correlation, relative to expected cross-correlation characteristics of the signal waveform.

6. The method of claim 3, wherein distinguishing between noise-based variations in the signal waveform and the variations induced by interaction and retransmission includes:

cross-correlating the signal waveform with a template waveform, computing a cumulative correlation as a sum of products of the cross correlation, and detecting the variations based on the cumulative correlation.

7. The method of claim 6, wherein cross-correlating the signal waveform with a template waveform includes cross-correlating respective portions of each waveform pertaining to a common time period, and producing a product for each of the respective portions that are cross-correlated with one another, and computing the cumulative correlation includes summing the products.

8. The method of claim 3, wherein distinguishing between noise-based variations in the signal waveform and the variations induced by interaction and retransmission includes:

cross-correlating the signal waveform with a template waveform, computing a cumulative correlation as a sum of products relating to the cross correlation, and detecting the variations as being induced by interaction and retransmission based on a slope of values of the cumulative correlation, relative to an expected slope of values of a cumulative correlation of the signal waveform.

9. The method of claim 3, wherein detecting variations in characteristics of the leading portion of the data symbol includes identifying a position of a portion of the data symbol in which the detected variations occur, and determining the condition is based on the identified position.

10. The method of claim 3, wherein detecting variations in characteristics of the leading portion of the data symbol is carried out for a plurality of symbols, and determining that the signal waveform has been interacted with and retransmitted is based on the detected variations in each of the plurality of symbols.

11. The method of claim 3, wherein detecting variations in characteristics of the leading portion of the data symbol relative to known characteristics of the leading portion of the data signal includes:

computing a ratio between a first likelihood function employing characteristics in the data symbol and a second likelihood function employing the known characteristics; and detecting variations based on the computed ratio and a threshold indicative of variations.

12. The method of claim 1, wherein detecting variations in characteristics of the leading portion of the data symbol relative to known characteristics of the leading portion of the data signal includes:

computing a ratio between a first likelihood function employing characteristics in the leading edge and a second likelihood function employing the known characteristics; and detecting variations based on the computed ratio and a threshold indicative of variations.

13. The method of claim 12, wherein computing the ratio includes computing the ratio based on a probability mass function characterizing timing of interaction within the data symbol.

14. The method of claim 1, wherein generating an output signal that provides vehicle access based on the determined condition includes unlocking an entry door to the vehicle via the generated output signal, in response to the condition not being indicative of interaction and retransmission of the signal.

15. An apparatus comprising:

a first communication circuit configured and arranged to communicate a signal waveform, having a data symbol with a leading portion and authentication information therein, between a remote circuit and a local circuit via which access to a vehicle is facilitated;

a second detection circuit configured and arranged to detect interaction, by a third circuit, with the signal waveform transmitted from the remote circuit by detecting variations in characteristics of the leading portion of the data symbol relative to characteristics of the leading portion of the signal waveform, determining a condition indicative of whether the signal waveform has been interacted with and retransmitted, in response to the detected variations in characteristics being indicative of a type of variation induced by interaction and retransmission; and a third output circuit configured and arranged to generate an output signal that provides vehicle access based on the determined condition.

16. The apparatus of claim 15, wherein the second detection circuit is configured and arranged to determine the condition by comparing changes in the leading portion of the data symbol with a retransmission profile that corresponds to changes induced by interaction and retransmission of the signal waveform, and determine a distance between the remote circuit and the local circuit based on the data symbol; and the third output circuit is configured and arranged to generate the output signal in response to the determined distance being less than a predetermined threshold and the comparing of the changes in the leading portion of the data signal not matching the retransmission profile, and inhibit the output signal in response to the changes in the leading portion of the data symbol matching the retransmission profile.

17. The apparatus of claim 15, wherein the second detection circuit is configured and arranged to determine the condition via distinguishing between noise-based variations in the signal waveform and variations induced by interaction and retransmission by cross-correlating the signal waveform with a template waveform, computing a cumulative correlation as a sum of products of the cross correlation, and detecting the variations based on the cumulative correlation.

18. The apparatus of claim 15, wherein the second detection circuit is configured and arranged to detect variations in characteristics of the leading portion of the data symbol relative to known characteristics of the leading portion of the data signal by:

computing a ratio between a first likelihood function employing characteristics in the leading portion and a second likelihood function employing the known characteristics; and detecting variations based on the computed ratio and a threshold indicative of variations.

19. The apparatus of claim 15, wherein the third output circuit is configured and arranged to unlock an entry door to the vehicle via the generated output signal, in response to the condition being determined as not being indicative of interaction and retransmission of the signal.

20. An apparatus comprising:

a remote communication circuit configured and arranged to communicate data for access to a vehicle that is distance-limited; and a vehicle access circuit configured and arranged with the remote communication circuit to control locking of an entry door to the vehicle by detecting a signal waveform corresponding to a signal transmitted by the remote communication circuit, the signal waveform having a data symbol with a leading portion and authentication information therein, comparing variations in characteristics of the leading portion of the data symbol relative to characteristics of the leading portion of the signal waveform, determining a condition indicative of whether the signal waveform has been interacted with and retransmitted, based on the comparing of the variations in characteristics being indicative of a type of variation induced by interaction and retransmission, and generating an output signal that controls locking of the entry door based on the determined condition.

* * * * *